US009251982B2

(12) United States Patent
Ludwig

(10) Patent No.: US 9,251,982 B2
(45) Date of Patent: Feb. 2, 2016

(54) SAFETY SWITCH FOR WELL OPERATIONS

(75) Inventor: Wesley N Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 390 days.

(21) Appl. No.: 13/812,513

(22) PCT Filed: Aug. 2, 2011

(86) PCT No.: PCT/US2011/046195

§ 371 (c)(1),
(2), (4) Date: Jan. 27, 2013

(87) PCT Pub. No.: WO2012/018763

PCT Pub. Date: Feb. 9, 2012

(65) Prior Publication Data

US 2013/0118761 A1 May 16, 2013

Related U.S. Application Data

(60) Provisional application No. 61/370,340, filed on Aug. 3, 2010.

(51) Int. Cl.

| | |
|---|---|
| ***H01H 35/32*** | (2006.01) |
| ***E21B 17/00*** | (2006.01) |
| ***E21B 43/119*** | (2006.01) |

(52) U.S. Cl.

CPC ..... *H01H 35/32* (2013.01); *E21B 17/00* (2013.01); *E21B 43/119* (2013.01)

(58) Field of Classification Search

USPC ..... 166/381, 113, 65.1

See application file for complete search history.

(56) References Cited

U.S. PATENT DOCUMENTS

| | | | | |
|---|---|---|---|---|
| 2,897,308 | A * | 7/1959 | Fergus | H01H 5/02 200/246 |
| 3,290,464 | A * | 12/1966 | Finnegan | H01H 13/46 200/460 |
| 3,766,833 | A * | 10/1973 | Kraemer | 92/37 |
| 4,757,165 | A * | 7/1988 | Marcoux | H01H 5/30 200/83 J |
| 4,938,120 | A | 7/1990 | Hafele et al. | |
| 5,149,927 | A * | 9/1992 | Stahly | H01H 35/343 200/83 J |
| 2001/0052427 | A1* | 12/2001 | Eppink et al. | 175/40 |
| 2002/0108747 | A1* | 8/2002 | Dietz et al. | 166/66.7 |
| 2003/0051881 | A1 | 3/2003 | Vinegar et al. | |

* cited by examiner

*Primary Examiner* — Taras P Bemko
(74) *Attorney, Agent, or Firm* — McGuireWoods LLP

(57) ABSTRACT

A pressure controlled safety switch comprises an electrical switch disposed in a cavity of a mandrel. A bellows assembly is operably engaged with the electrical switch. The bellows assembly is in fluid communication with a fluid surrounding the mandrel such that a pressure in the fluid no less than a predetermined pressure causes the bellows to activate the electrical switch, and a pressure in the fluid less than the predetermined pressure causes the bellows to deactivate the electrical switch.

15 Claims, 7 Drawing Sheets

SAFETY SWITCH FOR WELL OPERATIONS

BACKGROUND OF THE INVENTION

The present disclosure relates generally to the field of downhole tools for well operations.

As the oilfield industry moves to perform down hole operations as efficiently as possible, some operations formally done on wireline are being run on slickline, drill pipe, or other deployment means that do not contain an electrical conductor. Batteries may be used as a power source for these operations. For some types of operations, for example perforating, or running a neutron generator, accidental activation on, or near, the surface may cause injury to personnel and/or damage to equipment. Operations that were formally made safe by not applying power to the wireline are now being connected to a power source at the surface when, for example, the battery sub is activated or installed before descending down hole, resulting in the potential for surface activation if the device is mis-programmed, or has an electronics failure.

BRIEF DESCRIPTION OF THE DRAWINGS

A better understanding of the present invention can be obtained when the following detailed description of example embodiments are considered in conjunction with the following drawings, in which like elements are indicated by like reference indicators.

Figure 1:
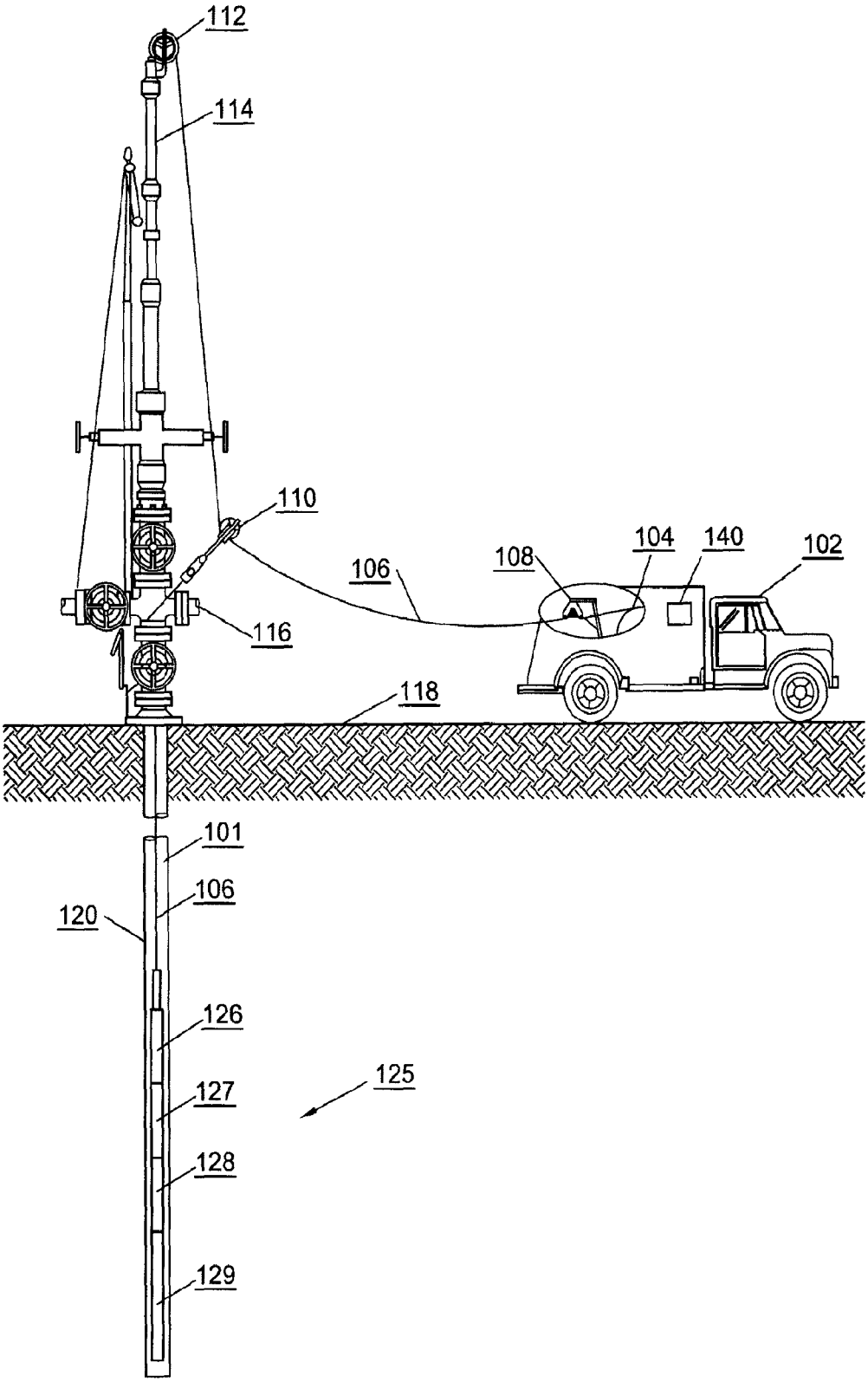
FIG. 1 shows an example of a rig-up for performing downhole well operations.

While the invention is susceptible to various modifications and alternative forms, specific embodiments thereof are shown by way of example in the drawings and will herein be described in detail. It should be understood, however, that the drawings and detailed description herein are not intended to limit the invention to the particular form disclosed, but on the contrary, the intention is to cover all modifications, equivalents and alternatives falling within the scope of the present invention as defined by the appended claims.

DETAILED DESCRIPTION

Described below are several illustrative embodiments of the present invention. They are meant as examples and not as limitations on the claims that follow.

FIG. 1 shows one example of a rig-up for performing down-hole well operations, also called well services, in a well bore 101 using a slickline 106. As used herein, well operations may comprise logging, fishing, completions, perforating, workover operations, and combinations thereof. Well services truck 102 may contain a number of different features, for example, for this application, truck 102 contains drum 104, which spools off slickline 106 through a combination measuring device/weight indicator 108. Slickline 106 is rigged through lower sheave wheel 110 and upper sheave wheel 112, and enters the well bore through pressure control equipment 114, used to contain well bore pressure while allowing slickline 106 to move freely in and out of the well bore. Slickline 106 enters the well bore at well head connection 116, upon which pressure control equipment is connected. Below surface 118, pipe or casing 120 may proceed to a bottom depth (not shown). Within casing 120 is well tool string 125, connected to slickline 106. Alternatively, well tool string 125 may extend into uncased sections of well bore 101.

Combination measuring device and weight indicator 108 measures the motion of slickline 106 as it goes into and out of the well bore, and sends representative signals to a data handling system 140 disposed in truck 102 in order to provide the operator with accurate depth data. Additionally, in the example shown, combination measuring device and weight indicator 108 contains a cable tension measuring sensor and sends a signal into the logging compartment of truck 102, indicating an increase in the tension on slickline 106. Alternatively, any other technique, known in the art, may be used to determine line tension and tool depth.

As used herein, a slickline cable comprises a single strand strength member having a relatively smooth outer surface. While the slickline strength member may be metallic, it is not used to conduct electrical signals or power.

Alternatively, well tool 125, may be run on drill pipe, coiled tubing, and any other suitable deployment technique known in the art. As used herein the term deploy is intended to mean extension and/or retrieval of a tool into the well.

In one example, well tool string 125 may comprise a power section 126 for supplying power to the downhole system. An electronics section 127 may be attached to power section 126. A safety switch system 128 may be attached between electronics section 127 and a well tool 129. Well tool 129 may comprise a logging tool, a completion tool, a fishing tool, a perforating tool, a workover tool, and combinations thereof.

Figure 2:
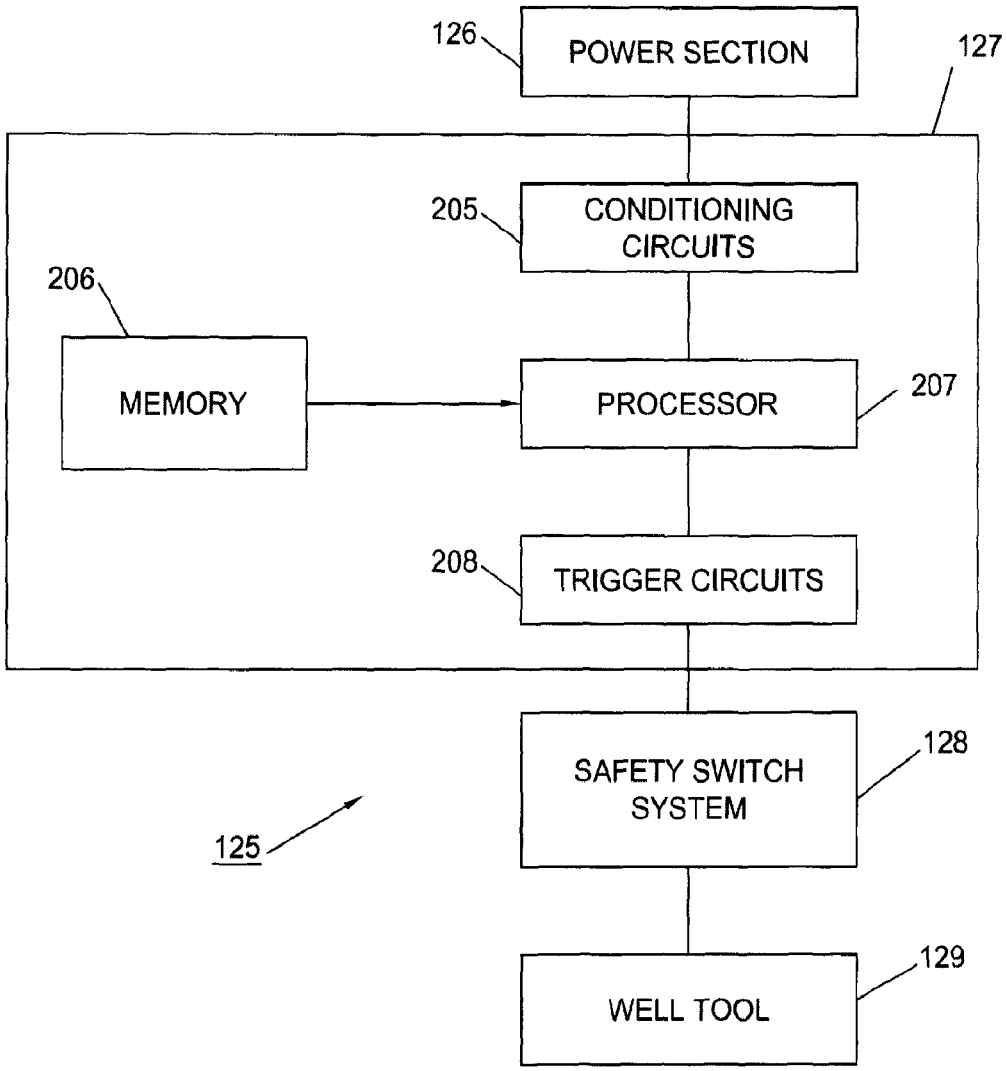
FIG. 2 shows a block diagram of one embodiment of a well tool string.
Figure 3A:
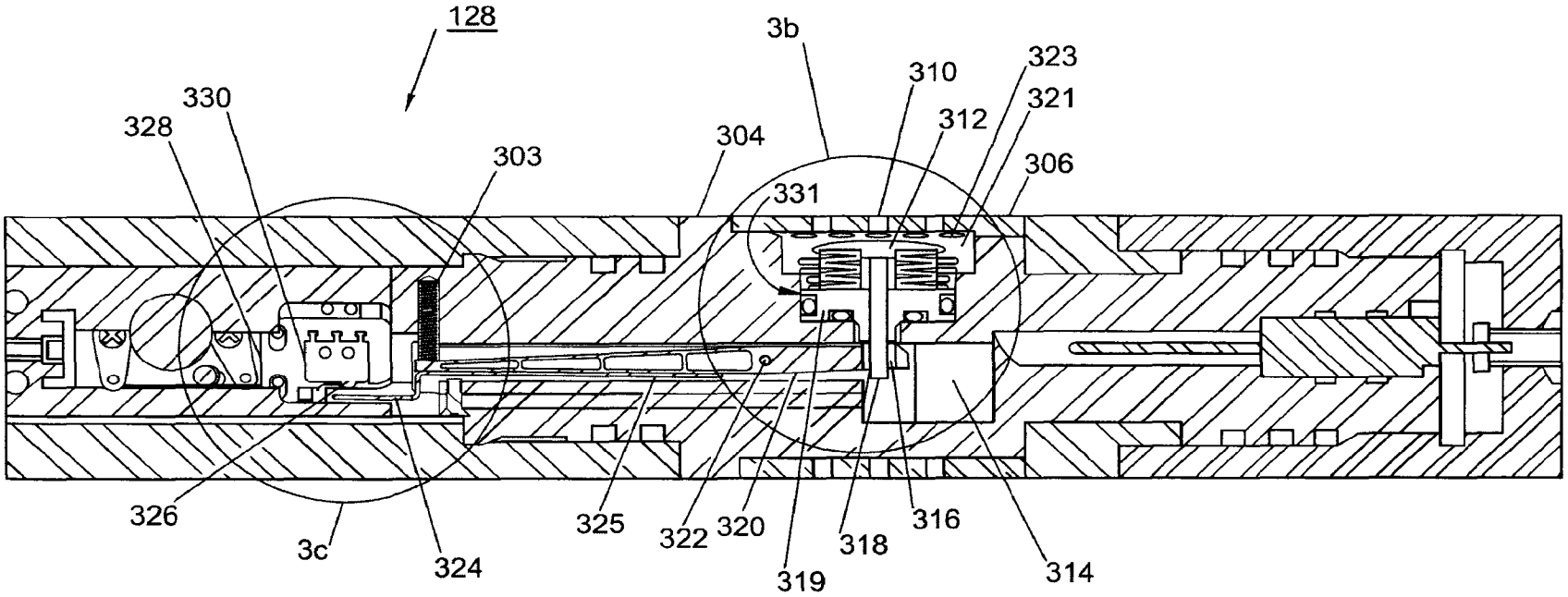
FIGS. 3A-3C show cross sections of one example of a safety switch system.
Figure 3B:
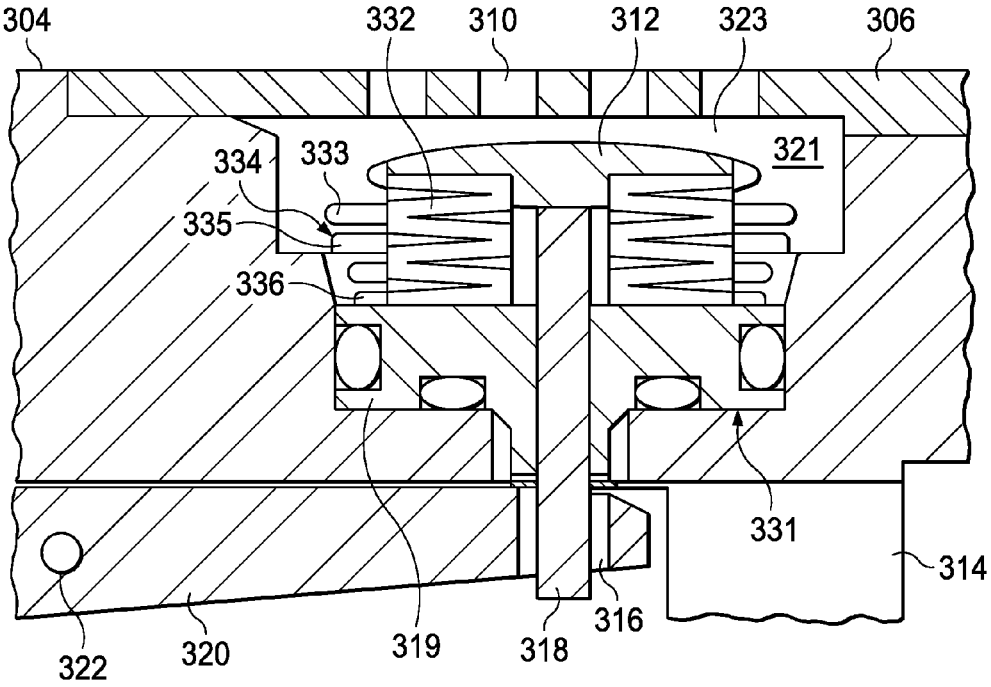
Figure 3C:
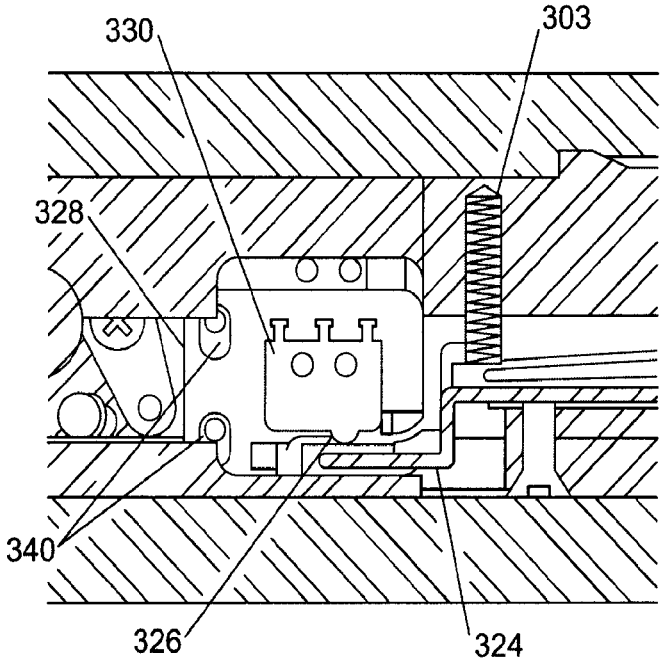
Figure 4:
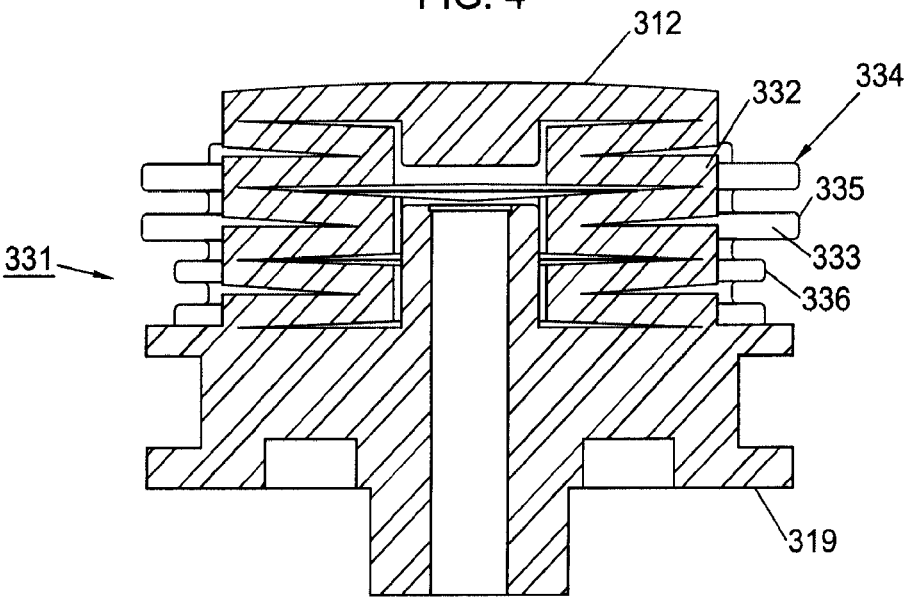
FIG. 4 shows an example of a bellows assembly for use in a safety switch system.

FIG. 2 shows a block diagram of one embodiment of well tool string 125. In one example, power section 126 may comprise batteries, for example lithium batteries. Alternatively, any other suitable battery type may be used. In another alternative, where flow is present in the wellbore, a downhole turbine generator may be used to extract power from the flowing fluid to generate suitable electrical power. As used herein, the term fluid is intended to comprise liquids, gases, liquid/solid mixtures, emulsions, and combinations thereof. The electronics section 127 may comprise suitable conditioning circuits 205 for powering the devices in electronics section 127, any active devices in safety switch system 128, and well tool 129. Electronics section 127 may also comprise a processor 207 in data communication with a memory 206 that may have suitable programmed instructions stored therein for controlling operation of tool string 125. Processor 207 may comprise one or more processors of a type known in the art. Processor 207 may act according to programmed instructions to activate trigger circuits 208 that activate well tool 125.

In one embodiment, safety switch system 128 comprises a high reliability system that is capable of relatively low switching pressures and extremely high overpressures. The system may prevent a tool, for example a perforating tool, from activating until the system has descended to a depth that builds a predetermined activating pressure to activate the switch system to arm the tool. In addition, the pressure activated safety switch system disclosed herein will switch to a safe position, deactivating the tool, when the pressure decreases below a predetermined deactivating pressure to ensure the device is safe upon retrieval from the well. High reliability is achieved by using flexing elements with low friction and hysteresis, and by supporting the deformable parts when pressures greatly exceed the switching pressure.

A cross section of one example of safety switch system 128 is shown in FIGS. 3A-3C and FIG. 4. In one embodiment, safety switch system 128 comprises a bellows assembly 331 having an edge welded inner bellows 332 welded to a cap 312 at one end and a base 319 at an end opposite the cap 312. The inner bellows is surrounded by an outer bellows 334, and the space between inner bellows 332 and outer bellows 334 is filled with oil 333. Alternatively, a rolling elastomeric bellows may be used as an outer bellows, for example a Bellofram brand bellows from Bellofram Corp, Newell, W Va. In yet another alternative embodiment, there may be no outer bellows such that formation fluid is in contact directly with inner bellows 332.

Bellows assembly 331 is inserted in a cavity 323 in mandrel 304 and protected by cover 306. Holes 310 in cover 306 allow wellbore fluid 321 to enter cavity 323. The outside of outer bellows 334 and cap 312 are exposed to well bore fluid 321 in cavity 323. The pressure of well bore fluid may be as high as 40,000 psi. The inside of mandrel 304 and inner bellows 332 is filled with a gas at substantially atmospheric pressure. The gas may comprise air, nitrogen, argon, other known inert gas, and combinations thereof. Pressure from the well bore fluid 321 acts to axially compress both bellows 334 and 332. In one example, the outer bellows resistance to axial compression is considered negligible compared to the resistance of the inner bellows 332. Once inner bellows 332 reaches its solid height, further increases in fluid pressure provide very little increase in stress, thus allowing bellows assembly 331 to handle a very high fluid pressure. In one example, outer bellows 334 has a small diameter section 336 and a large diameter section 335. The geometry of outer bellows 334 and the geometry of inner bellows 332 determine the volume between the two. As inner bellows 332 is compressed, outer bellows 334 is compressed as well. The overall length gets shorter. The function of the two diameters of outer bellows 334 is to allow them to be sized so that as the bellows assembly is compressed, the length of the larger diameter section gets longer while the length of the small diameter section gets shorter at a rate greater than the overall deflection of the bellows assembly. This allows the outer bellows to compensate for volume changes of the fluid between the two bellows due to temperature and pressure across the full range of motion of the bellows assembly. The outer bellows 334 does not have to compress fully, and has very little pressure differential across it. This makes it much less subject to debris affecting its operation. Outer bellows 334 protects inner bellows 332 from accumulating well bore fluids and particulate matter between the convolutions of inner bellows 332 thereby eliminating failures due to these contaminations.

In one embodiment, the motion of the inner bellows 332 is transmitted to a lever arm 320 by a pin 318 through the center of inner bellows 332 and base 319. Pin 318 engages lever arm 320 in slot 316. Lever arm 320 pivots about pin 322 in internal cavity 314. The other end of lever arm 320 is engaged with a compression spring 303. The force of compression spring 303 holds pin 318 in compression, and resists movement of lever arm 320 and pin 318 due to shock and vibration. In addition, compression spring 303 may act to return lever arm 320 to the inactivated position as inner bellows 332 returns to its uncompressed position, as pressure is reduced. Lever arm 320 may also comprise a preloaded cantilever spring 324 attached to lever arm 320 at 325. Cantilever spring 324 is formed to contact plunger pin 326 of switch 330. The preload on cantilever spring 324 is sufficient to actuate switch 330 before cantilever spring 324 is deflected away from lever arm 320. As inner bellows 332 moves through its range to a solid position, it causes lever arm 320 to move through its full range of motion. Cantilever spring 324 provides over travel of lever arm 320 past the actuation point of switch 330 without applying high forces to switch 330. This overtravel allows the actuation point of electrical switch 330 to be set anywhere in the usable range of lever 320 travel and makes the switching pressure adjustable over a large percentage of inner bellows 320 travel. For example, the pressure switch assembly may be set such that the actuation of switch 330 is set to occur when inner bellows 330 is approximately at the mid-point of its travel. If the lever arm is directly in contact with the switch, additional external pressure will cause additional force on switch 330, possibly damaging the switch. Cantilever spring 324 is substantially more flexible than lever arm 320 and imparts a much lower force to switch 330 during the additional travel of inner bellows 330 between the actuation point and the solid height of inner bellows 330.

In one example, switch 330 may be a commercially available miniature switch, for example a Micro Switch brand switch from Honeywell, Inc. of Minneapolis, Minn. Switch 330 may be mounted to an adjustable carrier plate 328 that is controllably movable to provide the proper setting point for actuation of the switch at the appropriate travel point of inner bellows 332. The position of plate 328 may be adjusted by turning an adjustment screw (not shown), and plate 328 may be locked in place with screws (not shown) installed in the slots 340 at the left side of carrier plate 328. In one embodiment, switch 330 may have a spring return to return lever arm 320 to an inactivated position as pressure on the bellows 332 is reduced below the actuation pressure.

The deflection of inner bellows 332 due to pressure is linear over a substantial portion of its travel, but non linear effects may be present at both ends of travel. In one example, the switch position may be adjusted such that the actuation point is not near the inner bellows travel end points. It is intended that the switching system provide for operation over a switching range of 100 psi to 5000 psi and to operate in a 40000 psi downhole environment. In one embodiment, multiple bellows assemblies 331 may be used to cover different operating ranges over the desired switching range. Bellows assemblies 331 with different actuation pressure ratings can be interchanged to make the pressure switch system actuate over a wide selection of activation pressures. Each of the bellows assemblies will have the same mechanical stroke, but will reach full stroke at different maximum pressures.

Figure 5:
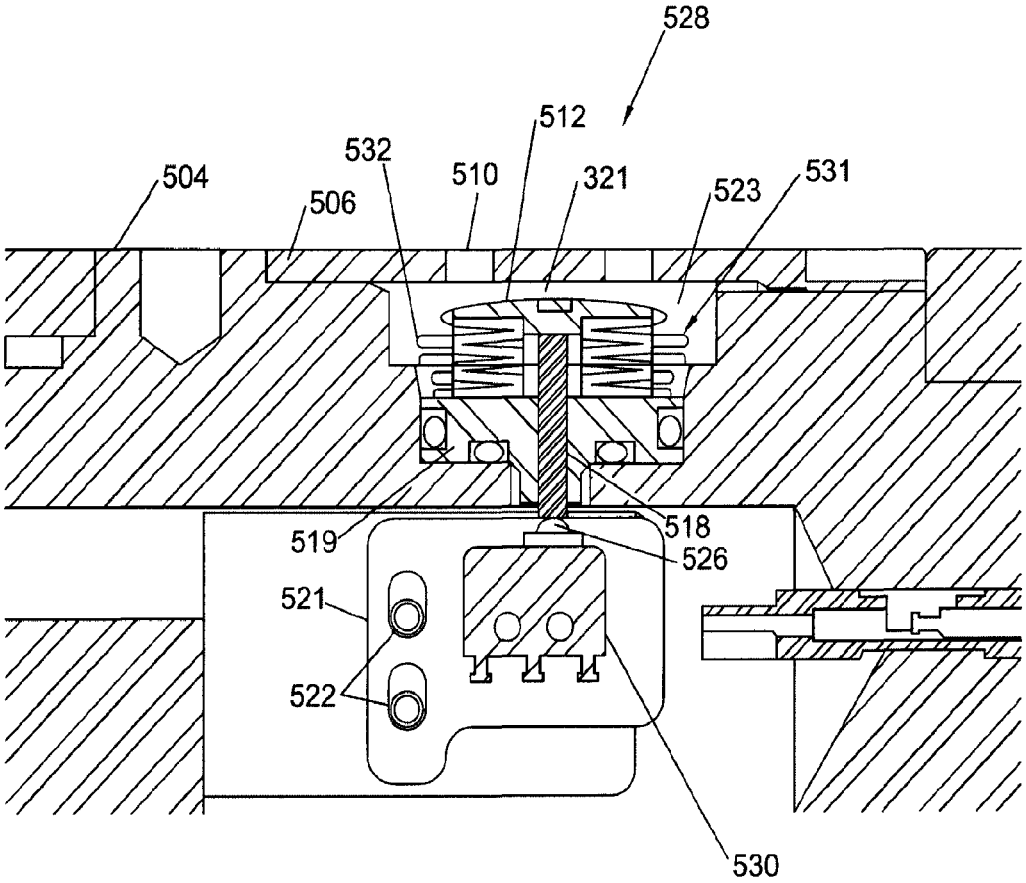
FIG. 5 shows another example of a safety switch system.

In another embodiment, see FIG. 5, safety switch system 528 comprises a bellows assembly 531 that has an edge welded bellows 532 welded to a cap 512 at one end and a base 519 at an end opposite the cap 512. Alternatively, a double bellows assembly, as described previously, may be used. Bellows assembly 531 is inserted in a cavity 523 in mandrel 504 and protected by cover 506. Holes 510 in cover 506 allow wellbore fluid 321 to enter cavity 523. The outside of bellows 532 and cap 512 are exposed to well bore fluid 321 in cavity 523. The pressure of well bore fluid may be as high as 40,000 psi. Pin 518 is attached to cap 512 and moves therewith. Pin 518 is in contact with the plunger pin 526 of switch 530. The inside of mandrel 504 and bellows 532 is filled with a gas at substantially atmospheric pressure. As pressure in fluid 321 increases, bellows 532 collapses toward switch 530 in a predictable manner such that pin 518 depresses plunger pin 526 and actuates switch 530. As shown in FIG. 5, the set point for switch actuation must be close to the solid height of bellows 532 to prevent damage to switch 530 with additional fluid pressure. The set point may be adjusted by moving switch 530 up, or down, on mounting plate 521, and locking switch 530 in place with screws 522.

Figure 6:
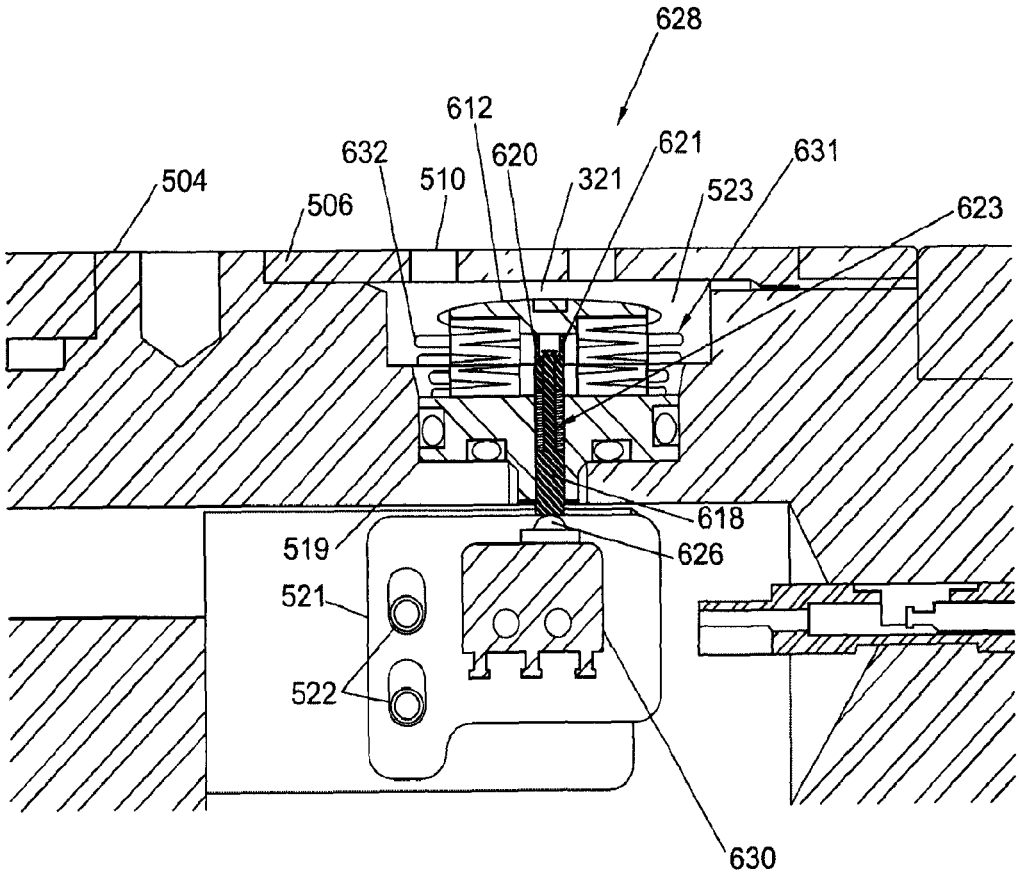
FIG. 6 shows yet another example of a safety switch system.

In yet another embodiment, see FIG. 6, a bellows assembly 631 may be installed in mandrel 504, described above. Bellows assembly 631 may comprise an edge welded bellows 632 welded to a cap 612 at one end and a base 519 at an end opposite the cap. Alternatively, a double bellows assembly, as described previously, may be used. The outside of bellows 632 and cap 612 are exposed to well bore fluid 321 in cavity 523. The pressure of well bore fluid may be as high as 40,000 psi. The inside of mandrel 504 and bellows 532 is filled with a gas at substantially atmospheric pressure. A spring energized pin assembly 620 is attached to cap 612 and engages plunger pin 626 of switch 630. Pin assembly 620 comprises a pin guide 621, a compression spring 623 and a pin 618. Pin guide 621 is in contact with cap 612. Pin 618 extends slidably through pin guide 621 and may be retained on a top end by flaring the top of pin 618. Alternatively, the top of pin 618 may be retained by a threaded fastener (not shown). The space between the bottom of pin guide 621 and the top shoulder of guide pin 618 captures compression spring 623. In one example, this spring cavity may be shorter than the free length of compression spring 623. This captures a pre-load on spring 623. The pre-load on spring 623 may be designed to be greater than the switch actuation force. This causes the pin assembly 620 to act as a solid pin at, or below, the actuation force so that the pin exactly follows the motion of the bellows, and therefore gives a precise switch point. No further compression of the spring occurs until after the switch has been activated. After activation the spring can then be compressed and serves to limit the force applied to switch 623. For example, as pressure in fluid 321 is increased, cap 612 is forced toward switch 630, causing pin guide 621 to act against spring 623 that in turn causes pin 618 to impart a load to plunger pin 626 of switch 630. Spring 623 may be preloaded, as described above, to impart sufficient force to actuate switch 630 at a desired motion point of bellows 632 as bellows 632 collapse. This allows the activation and deactivation of safety switch 628 at a predetermined fluid pressure. In addition, spring 623 may be designed using techniques known in the art to limit the load imparted to switch 630 to an allowable load for the selected switch. Spring 623 may comprise at least one of, a coil spring, a wave spring, and a disc spring.

In one operational example, a perforating operation may be desired at a predetermined location in the wellbore. Knowing the location, the downhole pressure may be estimated. In addition other operational situations may be considered. For example, on an offshore well, it would be prudent to set the switch activating and deactivating pressure to a level that ensures that the system is not armed until the perforating gun is below the sea bed level to prevent a misfire of the gun in the marine riser section. Once the appropriate activating and deactivating pressure is determined, the appropriate bellows assembly may be selected and installed in the switch mandrel. This may be done in the shop before the tool is sent to the rig, or alternatively, may be done in the field. As the tool is lowered to the preselected depth, the downhole pressure activates the switch, allowing operation of the well tool. During retrieval of the tool the switch is deactivated at the desired operating pressure to prevent well tool operation during the remainder of the retrieval cycle. For example, a misfiring perforating gun may be deactivated to prevent accidental firing near, or at, the surface. Other well and logging tools, for example a logging neutron generator known in the art, may use the safety switch described herein to ensure personnel and operational safety.

Numerous variations and modifications will become apparent to those skilled in the art. It is intended that the following claims be interpreted to embrace all such variations and modifications.

The invention claimed is:

1. A pressure controlled safety switch comprising:

an electrical switch disposed in a cavity of a mandrel; and a bellows assembly operably engaged with the electrical switch, the bellows assembly in fluid communication with a fluid surrounding the mandrel such that a pressure in the fluid no less than a predetermined pressure causes the bellows to activate the electrical switch, and a pressure in the fluid less than the predetermined pressure causes the bellows to deactivate the electrical switch; a pivoted lever arm disposed between and operatively coupled to the electrical switch and the bellows assembly such that movement of the bellows assembly causes the lever arm to activate and deactivate the electrical switch;

wherein the pivoted lever arm further comprises a cantilever spring attached to the pivoted lever arm, and an end of the cantilever spring engages the electrical switch.

2. The pressure controlled switch of claim 1 wherein the bellows assembly comprises an inner bellows and an outer bellows.

3. The pressure controlled switch of claim 2, wherein the outer bellows comprises at least one of a metallic bellows and an elastomer bellows.

4. The pressure controlled switch of claim 1 wherein the bellows assembly comprises a plurality of bellows assemblies wherein each of the bellows assemblies is sized to cover a separate predetermined pressure range.

5. The pressure switch of claim 4 wherein the electrical switch is located such that actuation occurs in the range of about 20% to about 80% of a total travel of the bellows assembly.

6. The pressure controlled switch of claim 1 wherein the predetermined pressure comprises a range of about 100 psi to about 5000 psi, and the pressure in the fluid comprises a range of about 100 psi to about 40000 psi.

7. The pressure controlled switch of claim 1 wherein the bellows assembly further comprises a spring energized pin engaged with the electrical switch.

8. A well tool string comprising:

a power section;

a well tool; and a pressure controlled safety switch operatively coupled to both the power section and the well tool to operatively couple the well tool and the power section when a wellbore pressure is no less than a predetermined pressure and to operatively uncouple the well tool and the power section when the wellbore pressure is less than the predetermined pressure; wherein the safety switch comprises:

an electrical switch disposed in a cavity of a mandrel in the well tool string;

a bellows assembly operably engaged with the electrical switch, the bellows assembly in fluid communication with a fluid surrounding the mandrel such that a wellbore pressure no less than a predetermined pressure causes the bellows to activate the electrical switch, and a wellbore pressure less than the predetermined pressure causes the bellows to deactivate the electrical switch; and a pivoted lever arm disposed between and operatively coupled to the electrical switch and the bellows assembly such that movement of the bellows assembly causes the lever arm to activate and deactivate the electrical switch;

wherein the pivoted lever arm further comprises a cantilever spring attached to the pivoted lever arm, and an end of the cantilever spring engages the electrical switch.

9. The well tool string of claim 8 wherein the electrical switch is located such that actuation occurs in the range of about 20% to about 80% of a total travel of the bellows assembly.

10. The well tool string of claim 8 wherein the predetermined pressure comprises a range of about 100 psi to about 5000 psi, and the pressure in the fluid comprises a range of about 100 psi to about 40000 psi.

11. The well tool string of claim 8 wherein the bellows assembly further comprises a spring energized pin engaged with the electrical switch.

12. A method for controlling activation of a well tool comprising:

selecting a bellows assembly for operation at a predetermined pressure;

installing the bellows assembly in a mandrel in a tool string;

operatively coupling the bellows assembly to an electrical switch located in the mandrel;

exposing the bellows assembly to a first pressure in a fluid surrounding the well tool no less than the predetermined pressure causing the bellows to activate the electrical switch;

wherein the coupling of the bellows assembly and the electrical switch further comprises a pivoted lever arm disposed between and operatively coupled to the electrical switch and the bellows assembly such that movement of the bellows assembly causes the lever arm to activate the electrical switch;

wherein the pivoted lever arm further comprises a cantilever spring attached to the pivoted lever arm, and an end of the cantilever spring engages the electrical switch.

13. The method of claim 12 further comprising exposing the bellows assembly to a second pressure in the fluid surrounding the well tool less than the predetermined pressure causing the bellows assembly to deactivate the electrical switch.

14. The method of claim 12 further comprising selecting the bellows assembly such that actuation of the electrical switch occurs in the range of about 20% to about 80% of a total travel of the bellows assembly.

15. The method of claim 12 wherein operatively coupling the bellows assembly to an electrical switch located in the mandrel comprises operatively engaging a first end of the pivoted lever arm to the electrical switch and operatively engaging a second end of the pivoted lever arm to the bellows assembly.

* * * * *